United States Patent [19]

Smith

[11] 4,314,733

[45] Feb. 9, 1982

[54] SPECIALIZED FILING CABINET

[76] Inventor: Clark K. Smith, 5406 Wedding Ct., Waldorf, Md. 20601

[21] Appl. No.: 77,134

[22] Filed: Sep. 19, 1979

[51] Int. Cl.[3] ..... A47B 63/00; A47B 91/02

[52] U.S. Cl. ..... 312/183; 312/311; 312/293; 312/250; 211/50; 248/167

[58] Field of Search ..... 312/183, 184, 185, 188, 312/11, 12, 292, 293, 320, 311, 250; 109/56; 211/50; 248/528, 167, 188.6

[56] References Cited

U.S. PATENT DOCUMENTS

| | | | |
|---|---|---|---|
| 270,888 | 1/1883 | Christie | 312/293 |
| 363,242 | 5/1887 | Johnson | 312/331 |
| 497,235 | 5/1893 | Fox | 312/320 |
| 658,310 | 9/1900 | Babb | 312/320 |
| 979,189 | 12/1910 | Moler | 312/274 |
| 1,372,991 | 3/1921 | Beadle | 248/167 |
| 1,749,937 | 3/1930 | Dettenborn | 312/293 |
| 1,750,291 | 3/1930 | Whetstone | 109/56 |
| 1,812,890 | 7/1931 | McWhorter | 312/250 |
| 2,617,699 | 11/1952 | Sullivan | 312/320 |
| 2,660,506 | 11/1953 | Wright | 312/311 |
| 2,739,024 | 3/1956 | Elman | 312/283 |
| 2,786,641 | 3/1957 | Applegate | 248/528 |
| 2,806,311 | 9/1957 | Havens | 312/293 |
| 2,883,253 | 4/1959 | Litman | 312/293 |
| 3,365,259 | 1/1968 | Heisman et al. | 312/194 |
| 3,433,548 | 3/1969 | Moore | 312/184 |
| 3,753,606 | 8/1973 | Ozeki | 312/183 |
| 3,853,364 | 12/1974 | Lundberg | 312/184 |
| 3,887,253 | 6/1975 | Bridges et al. | 312/250 |
| 3,970,010 | 7/1976 | Cantley | 312/311 |
| 4,114,965 | 9/1978 | Oye et al. | 312/209 |

*Primary Examiner*—Victor N. Sakran

*Attorney, Agent, or Firm*—Blair, Brown & Kreten

[57] ABSTRACT

Disclosed herein is a space saving filing cabinet designed to be deployed in a closet. The cabinet is an elongated narrow rectangular solid with a mounting tab on the top which captures the hanger bar in the closet and stabilizer legs pivotally mounted to the bottom of the cabinet which fan out and stabilize the cabinet when in use. Access is gained to the contents of the filing cabinet by withdrawing the inner cabinet from the outer cabinet. The inner cabinet slides forward on tracks mounted inside the outer cabinet. Once extracted the inner cabinet reveals drawers situated on the side face of the inner cabinet. Each drawer is a truncated rectangular box provided with a hinged door and two knobs. Each drawer is mounted within the inner cabinet by wheels which follow grooves located in the inner cabinet, so that the bottom of each drawer will swing outwardly from the inner cabinet providing easy access to the contents of the drawer. An alternative mode of the present invention contemplates the use of the outer cabinet only. Access to the contents of the cabinet is gained through hinged doors provided on the outer face of the cabinet.

16 Claims, 9 Drawing Figures

FIG. 9
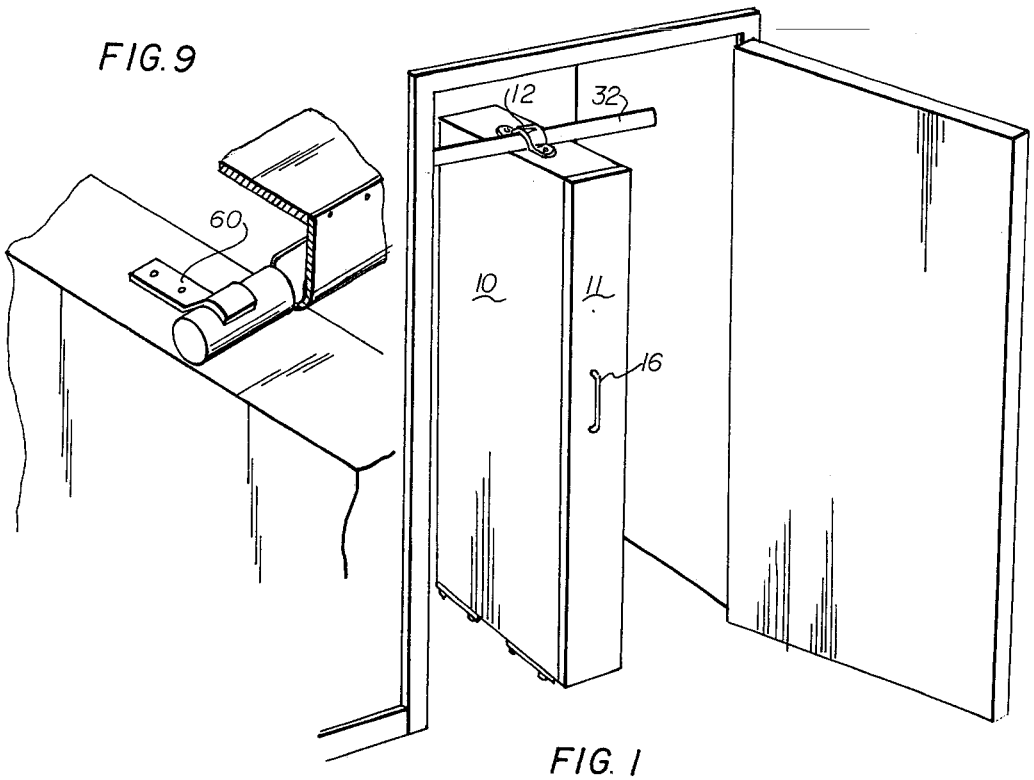
FIG. 1
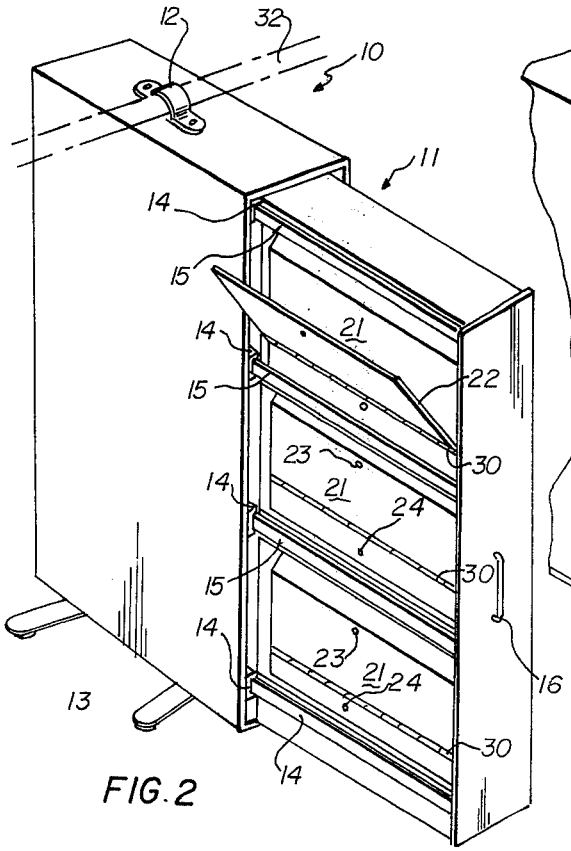
FIG. 2
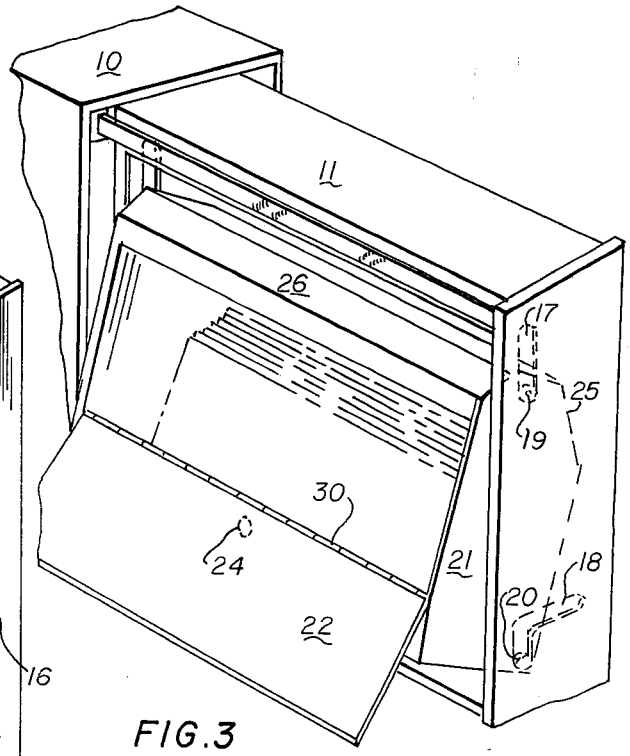
FIG. 3

FIG. 4
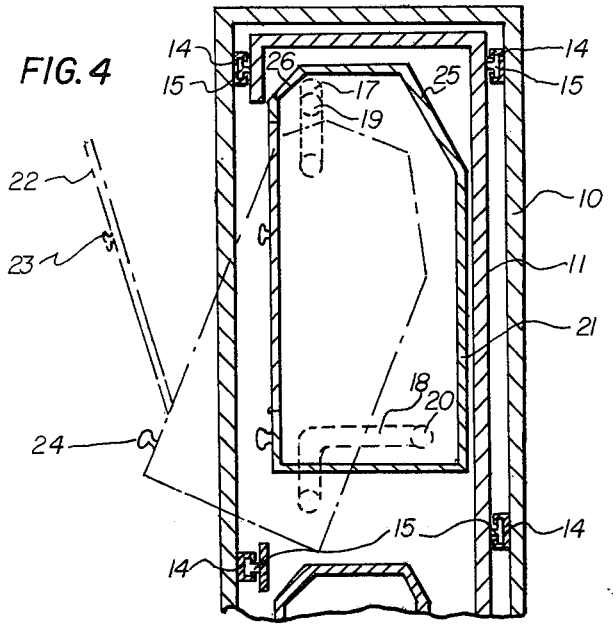
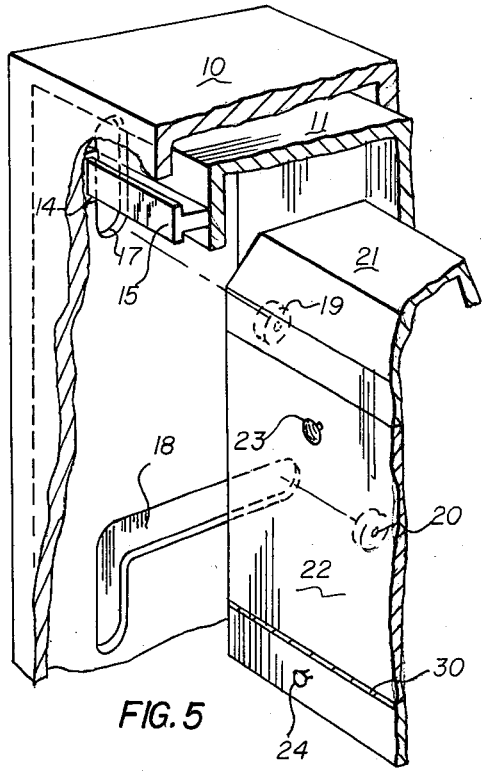
FIG. 5
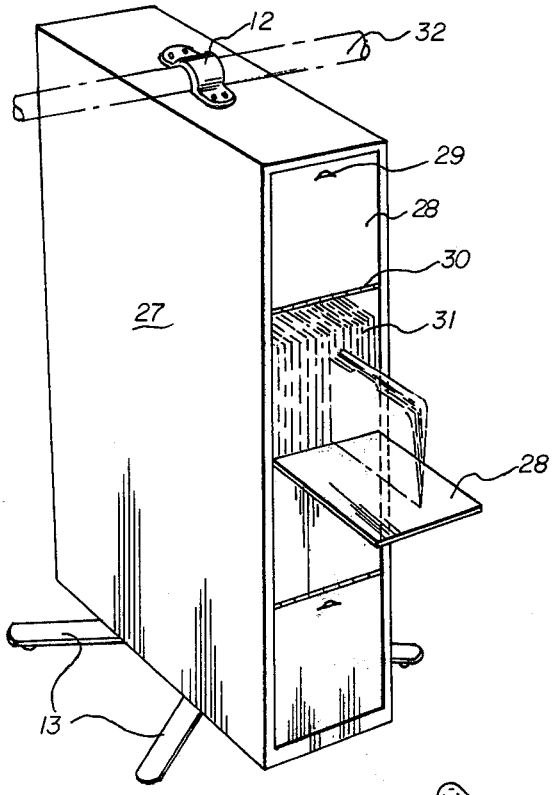
FIG. 6
FIG. 7
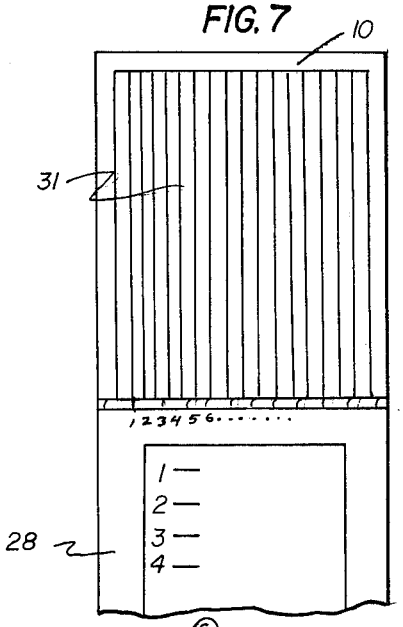
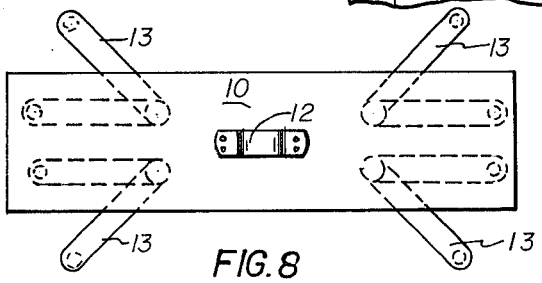
FIG. 8

SPECIALIZED FILING CABINET

BACKGROUND OF THE INVENTION

Bulky unattractive filing cabinets are certainly appropriate for office use, but in the home where appearance and space saving are more important, a need exists for a filing system that can be stored unobtrusively in a closet and still provide easy access to the documents and papers contained therein. Previous filing systems, although more than adequate for office use, are not designed to be conveniently tucked away in a closet to save space and maintain the decoor of the home setting.

The following reference appear to be germane to the patentability of the present invention: U.S. Pat. Nos. 979,189 (Moler); 3,433,548 (Moore); 2,739,024 (Elman); 3,853,364 (Lundberg); 3,365,259 (Heisman et al).

Of the reference cited none teaches the use of a space saving filing cabinet specifically designed to be deployed in a closet. Furthermore, although coincidental structural similarities exist between the present invention and the prior art, none of the references contemplates the exact structure used in the present invention. Therefore, it is believed that the present invention is clearly distinguishable from the prior art.

SUMMARY AND OBJECTS OF THE INVENTION

Accordingly, it is a primary object of the present invention to provide a filing cabinet that may be inconspicuously stored, yet provide easy access. Ths is accomplished in the present invention by providing a filing system designed to be mounted inside a closet without taking up much more space than five or six suits hung side by side. Furthermore, easy access to the contents of the cabinet is gained by providing an inner cabinet that slides out presenting a series of drawers that allow easy access to documents and papers stored therein.

It is a further object of the present invention that it be easily installed but securely mounted and stable during use. This is accomplished by providing a mounting tab that captures the hanger bar in a closet. Stability is insured by the stabilizing bars which fan out from the bottom of the cabinet.

It is a further object of the present invention to provide a filing drawer which easily displays contents. This is accomplished in the present invention by providing a filing drawer mounted on wheels so that the bottom of the filing drawer swings outwardly from the inner cabinet and locks into position so that the contents of the drawer are displayed to the user. It is a further object of the present invention to provide an alternative mode of use, which is achieved by providing the cabinet with hinged doors on its outer face instead of a slidably mounted inner cabinet.

Other objects and advantages will become apparent in the following specification when considered in light of the attached drawings.

BRIEF DESCRIPTION OF THE DRAWINGS

FIG. 1 is a perspective view of the present invention as it would appear installed in a closet;

FIG. 2 is a perspective view of the outer cabinet with the inner cabinet withdrawn;

FIG. 3 is a perspective view of a portion of the inner cabinet detailing the file drawer;

FIG. 4 is a sectional end view of an upper portion of the outer and inner cabinet showing the filing drawer disposed in two positions;

FIG. 5 is a perspective view of an upper portion of the outer and inner cabinets detailing the location of the grooves and wheels that allow the filing drawer to pivot;

FIG. 6 is a perspective view of the cabinet deployed in its alternative mode;

FIG. 7 is a closeup end view of FIG. 6 showing the file racks and the index card located on the back of each file door;

FIG. 8 is a top view of the cabinet showing the stabilizer arms in both the extended and withdrawn position; and FIG. 9 is a view of another form of the hanger bar.

DESCRIPTION OF THE PREFERRED EMBODIMENT

Referring now to the drawings in detail wherein like reference characters indicate like parts throughout the several figures, the reference numeral 10 refers generally to the outer cabinet and reference numeral 11 refers generally to the inner cabinet. The outer cabinet 10 is an elongated open faced rectangular solid with the open side being the narrow outer face. Likewise, the inner cabinet 11 is an open sided elongated rectangular solid, only the open side of the inner cabinet 11 is located on the broad side face of the inner cabinet 11. The inner cabinet 11 is disposed within the outer cabinet 10 and slides in and out on T-shaped rails 15 disposed horizontally along the rims of the open faced side and disposed horizontally along the back face of the inner cabinet 11. The rails 15 register with and mate with C-shaped tracks 14 horizontally mounted on the inside of the outer cabinet 10. The outer cabinet 10 is mounted inside a closet with a mounting tab 12 located on the top of the outer cabinet which captures the hanger bar 32 installed in most closets. Located on the bottom of the outer cabinet 10 are pivoting stabilizer bars 13 which fan out and stabilize the cabinet during use.

The open face side of the inner cabinet 11 presents a series of file drawers 21 contained within the inner cabinet. Each file drawer 21 is a truncated rectangular box with two truncated faces 25 and 26 and a door 22 connected to the file drawer by means of a piano hinge 30. The outer face of each drawer is supplied with two knobs 23 and 24, one located on the door 22 and one located on the bottom of the drawer beneath the piano hinge 30. Opposing ends of each drawer 21 are provided with a pair of wheels 19 and 20 located at the top and bottom outer surface of each end. The wheels 19 and 20 mate with and follow grooves 17 and 18 located on opposing ends of the inner cabinet. The upper groove 17 is substantially vertical, while the lower groove is substantially L-shaped with a smaller leg segment vertically oriented and a longer leg segment horizontally disposed.

The track wheels and grooves mount the file drawer within the inner cabinet. Pulling outwardly on the lower knob 24 located on the file drawer 21 causes the bottom of the file drawer to swing outwardly as the bottom track wheel 20 follows the lower groove 18 finally slipping into the vertical segment of the L-shaped groove 18 which locks the drawer in an outwardly disposed posture. This allows easy access to the contents of the drawer which are now displayed to the user. A slight upward pull on the lower knob 24 followed by a slight horizontal push returns the file drawer to its storage position. The above described sequence is clearly directed in FIGS. 3, 4 and 5. Then all the file drawers are returned to the storage position, a slight push on the handle 16 located on the outer face of the inner cabinet 11 returns the inner cabinet to its storage position within the outer cabinet 10.

FIGS. 6 and 7 illustrate the use of the filing cabinet in its alternative mode. Reference numeral 27 refers generally to the outer cabinet in the alternative mode. In this mode the inner cabinet 11 is not employed. Instead, the outer face of the outer cabinet 27 is provided with a series of hinged doors 28 supplied with handles 29. Each door opens upon a rectangular chamber provided with a series of file racks 31 as depicted in FIG. 7. The back of each door 28 contains an index card referencing which materials are to be found within which rack. The mounting bracket 12 and the stabilizer bars 13 are the same in both modes.

FIG. 9 shows an arrangement wherein the file apparatus engages a closet hanger trough of substantially "J" shaped configuration. As shown, an upwardly extending goose necked support rod 60 terminates in a transverse cylinder 61 which lies in the trough.

Having thus described the preferred embodiment of the invention it should be understood that numerous structural modifications and adaptations may be resorted to without departing from the spirit of the invention.

What is claimed is:

1. A filing cabinet comprising: outer cabinet means, inner cabinet means, drawer means on said inner cabinet means to provide access to an inner filing area of said filing cabinet and plural stabilizer bars pivotally connected to a bottom face of said outer cabinet characterized by plural horizontal legs each pinned at an extremity thereof which when fanned out in a substantially horizontal plane form a cross-shaped support, wherein said inner cabinet means connected to said outer cabinet means through an open sided rectangular track placed on said outer cabinet, a T-shaped rail slideably disposed in said track and fastened to said inner cabinet, and inner cabinet formed as an open-sided rectangle and carrying said rails, wherein said drawer means comprises a rectangular box having upper truncated edge portions, said drawer means connected to said inner cabinet means through upper and lower track wheels carried on said drawer means fastened within upper and lower grooves on said inner cabinet.

2. The device of claim 1 wherein said upper groove is vertically oriented and said lower groove is substantially L-shaped with a smaller leg segment vertically oriented and a longer leg segment horizontally disposed.

3. The device of claim 2 wherein said drawer means include a door on one face thereof hinged thereto.

4. The device of claim 3 wherein said rails are disposed between plural drawer means and along an opposed side of said inner cabinet, and cooperate with complementally disposed tracks on said outer cabinet.

5. The device of claim 4 including handles on said door of said drawer means to assist in deploying said drawer means.

6. The device of claim 5 wherein said drawer means comprises a hinged door fastened on said outer cabinet.

7. The device of claims 5 or 6 wherein said cabinet means fasten to a hanger bar by a downwardly turned U tab fastened to said outer cabinet and overlying said hanger bar.

8. The device of claims 6 or 5 wherein said cabinet means fastens to a J-shaped hanger bar by means of a gooseneck support rod affixed to said cabinet means, said rod provided with a transverse cylinder disposed within a trough of said hanger.

9. A filing cabinet comprising: outer cabinet means, inner cabinet means, drawer means on said inner cabinet means to provide access to an inner filing area of said filing cabinet including stabilizer bars pivotally connected to a bottom face of said outer cabinet characterized by plural horizontal legs pinned at an extremity thereof when when fanned out form a cross-shaped support wherein said inner cabinet means connected to said outer cabinet means through an open sided rectangular track placed on said outer cabinet, a T-shaped rail slidably disposed in said track and fastened to said inner cabinet, and inner cabinet formed as an open-sided rectangle and carrying said rails and wherein said drawer means comprises a rectangular box having upper truncated edge portions, said drawer means connected to said inner cabinet means through upper and lower track wheels carried on said drawer means fastened within upper and lower grooves on said inner cabinet.

10. The device of claim 9 wherein said upper groove is vertically oriented and said lower groove is substantially L-shaped with a smaller leg segment vertically oriented and a longer leg segment horizontally disposed.

11. The device of claim 10 wherein said drawer means include a door on one face thereof hinged thereto.

12. The device of claim 11 wherein said rails are disposed between plural drawer means and along an opposed side of said inner cabinet, and cooperate with complementally disposed tracks on said outer cabinet.

13. The device of claim 12 including handles on said door of said drawer means to assist in deploying said drawer means.

14. The device of claim 13 wherein said drawer means comprises a hinged door fastened on said outer cabinet.

15. The device of claims 12 or 13 wherein said cabinet means fasten to a hanger bar by a downwardly turned U tab fastened to said outer cabinet and overlying said hanger bar.

16. The device of claims 13 or 14 wherein said cabinet means fastens to a J-shaped hanger bar by means of a gooseneck support rod affixed to said cabinet means, said rod provided with a transverse cylinder disposed within a trough of said hanger.

* * * * *